United States Patent [19]

Rosenbaum

[11] Patent Number: 4,637,284

[45] Date of Patent: Jan. 20, 1987

[54] RATCHET-ACTION OPEN-END WRENCH

[76] Inventor: Martin J. Rosenbaum, P.O. Box 2402, Bridgeport, Conn. 06606

[21] Appl. No.: 771,635

[22] Filed: Sep. 3, 1985

[51] Int. Cl.[4] ..... B25B 13/12

[52] U.S. Cl. ..... 81/179; 81/129

[58] Field of Search ..... 81/129, 179

[56] References Cited

U.S. PATENT DOCUMENTS

| | | | |
|---|---|---|---|
| 770,699 | 9/1904 | Randall | 81/179 |
| 2,692,524 | 10/1954 | Grant et al. | 81/179 |
| 2,959,996 | 11/1960 | Wheeler | 81/179 |
| 3,306,142 | 2/1967 | Buteau | 81/179 |
| 4,437,364 | 3/1984 | Martinmaas | 81/179 |

FOREIGN PATENT DOCUMENTS

| | | | |
|---|---|---|---|
| 101693 | 3/1941 | Sweden | 81/179 |

*Primary Examiner*—Frederick R. Schmidt
*Assistant Examiner*—Debra S. Meislin
*Attorney, Agent, or Firm*—H. Gibner Lehmann; K. Gibner Lehmann

[57] ABSTRACT

A ratchet-action open-end wrench having jaw portions one of which is translationally movable on a handle end along an oblique path, between nut-gripping and nut-releasing positions. Biasing means urges the movable jaw portion toward its jaw-gripping position, wherein cooperable, separable interfitting means on said handle and jaw portion tend to resist shifting of the latter to the nut-releasing position. For such condition, the movable jaw portion is set, and the wrench is thus conditioned to drive the nut when the handle is swivelled forward. The movable jaw portion in addition to its main translational movement, can initially rock slightly to disengage the interfitting means, such rocking being effected by a backward movement of the handle whereby translational shifting of the jaw portion can occur to the nut-releasing position which then permits a bypass or ratchet action of the wrench to be had for obtaining a new, advancing grip on the nut.

3 Claims, 13 Drawing Figures

TIGHTEN
RATCHET

RATCHET-ACTION OPEN-END WRENCH

BACKGROUND

This invention relates to open-end wrenches, and more particularly to wrenches of this type which are capable of a ratchet-like action when engaged with an hexagonal nut or fastening.

Numerous open-end ratchet-type wrenches have been proposed and produced in the past, to facilitate the tightening and loosening of nuts and bolts especially where these are located in awkward places or cramped areas. Some representative wrenches of this type are shown and described in the following U.S. Pat. Nos.: 749,134; 770,574; 1,015,504; 1,183,371; 1,305,571; 3,165,015; and 3,901,106.

These patented devices have not come into universal use for various reasons. Either the constructions were too complicated and costly to produce, or else too large or bulky, or else limited as to their scope. For example, the wrench of U.S. Pat. No. 770,574 is operative only in connection with square nuts or square bolt heads, and has no utility for hexagonal fitments.

Most of the above patented devices employ pivotal mountings for their movable jaws, and such mountings are often yieldable or lacking in strength whereby the wrench will lose its usefulness after a period.

The last four of the patented devices in the above listing are characterized by multiple components, increased bulk and complexity, and difficulty of manufacture whereby their wide acceptance by the trade did not occur. The wrench of U.S. Pat. No. 749,134 employs an outboard spring 12 which increases the bulk or size of the jaw assemblage, and is subject to distorting forces that can defeat its operation. Also, this wrench depends on the strength of a single pivot pin for proper functioning.

U.S. Pat. No. 1,015,504 shows a wrench which cannot be slid edgewise onto a nut or bolt head but instead requires that it be applied laterally and in an axial direction toward the end of the hexagonal part.

SUMMARY

The above drawbacks and disadvantages of the prior patented wrenches are obviated by the present invention, which has for one object the provision of a novel and improved ratchet-type open-end wrench which has no exterior props or parts adapting it to a ratchet action but instead presents essentially the same outward configuration and appearance as an ordinary non-ratchet type open end wrench.

Another object of the invention is to provide an improved ratchet-type open-end wrench in accordance with the foregoing, which is especially simple in construction and comprises essentially the same main configuration and structures as an ordinary wrench with the exception that one jaw portion is movably mounted on the handle component.

Still another object of the invention is to provide an improved ratchet-type open-end wrench as above set forth, which is especially strong and sturdy and not likely to fail or malfunction over an extended period of use.

Yet another object of the invention is to provide an improved ratchet-type open-end wrench as characterized above, wherein the various components are simple and readily fabricated by known manufacturing processes, and wherein the overall cost including labor and materials is kept to a minimum.

A further object of the invention is to provide an improved ratchet-type open-end wrench of the kind indicated, which is foolproof in its operation, and easily and quickly mastered as to its use.

A still further object of the invention is to provide an improved ratchet-type open-end wrench as above outlined, which can be accommodated in the same space as that required by ordinary, non-ratchet type wrenches.

Other features and advantages will be hereinafter brought out.

In accomplishing the above objects the invention provides an elongate handle having a pair of jaw portions at one end for engagement with an hexagonal nut or bolt head, one of said jaw portions being slidably mounted for movement in an oblique path with respect to the other jaw portion and handle. Means are provided, biasing said movable jaw portion from its open, nut-releasing position to a closed, nut-gripping and nut-driving position. The handle and movable jaw portion have cooperable, separable interfitting means normally tending to resist shifting of the jaw portion from its closed, nut-gripping position. However, when in such position, the movable jaw portion can be rocked slightly to disengage the interfitting means, such disengagement occurring automatically in response to nut pressure on the movable jaw portion at a point removed from its nut-engaging face, such pressure resulting from backward movement of the wrench handle. Forward movement of the handle, on the other hand, increases the detent action of the interfitting means and securely fixes the movable jaw in the driving position where it is effective for either tightening or loosening the nut or bolt, depending on the manner that the wrench was initially applied thereto.

The slide mounting means for the movable jaw portion comprises a dovetail on the handle and a dovetail slot in the jaw portion, as well as a simple pin-and-slot connection between the handle and jaw portion. Such pin-and-slot connection additionally functions as a pivot, in conjunction with the limited rocking movement of which the movable jaw is capable when in its gripping position. A pusher surface on the movable jaw portion is adapted for engagement by a corner of the hexagonal nut or bolt head, to initiate the limited rocking movement of the jaw when the handle is moved backward. The dovetail structures provide an especially simple and sturdy mounting for the movable jaw portion, which is not likely to fail or malfunction.

In the accompanying drawings, showing several embodiments of the invention:

Figures 1, 2, 3, 4, 5, 6, 7, 8, 9, 10, 11, 12, 13:
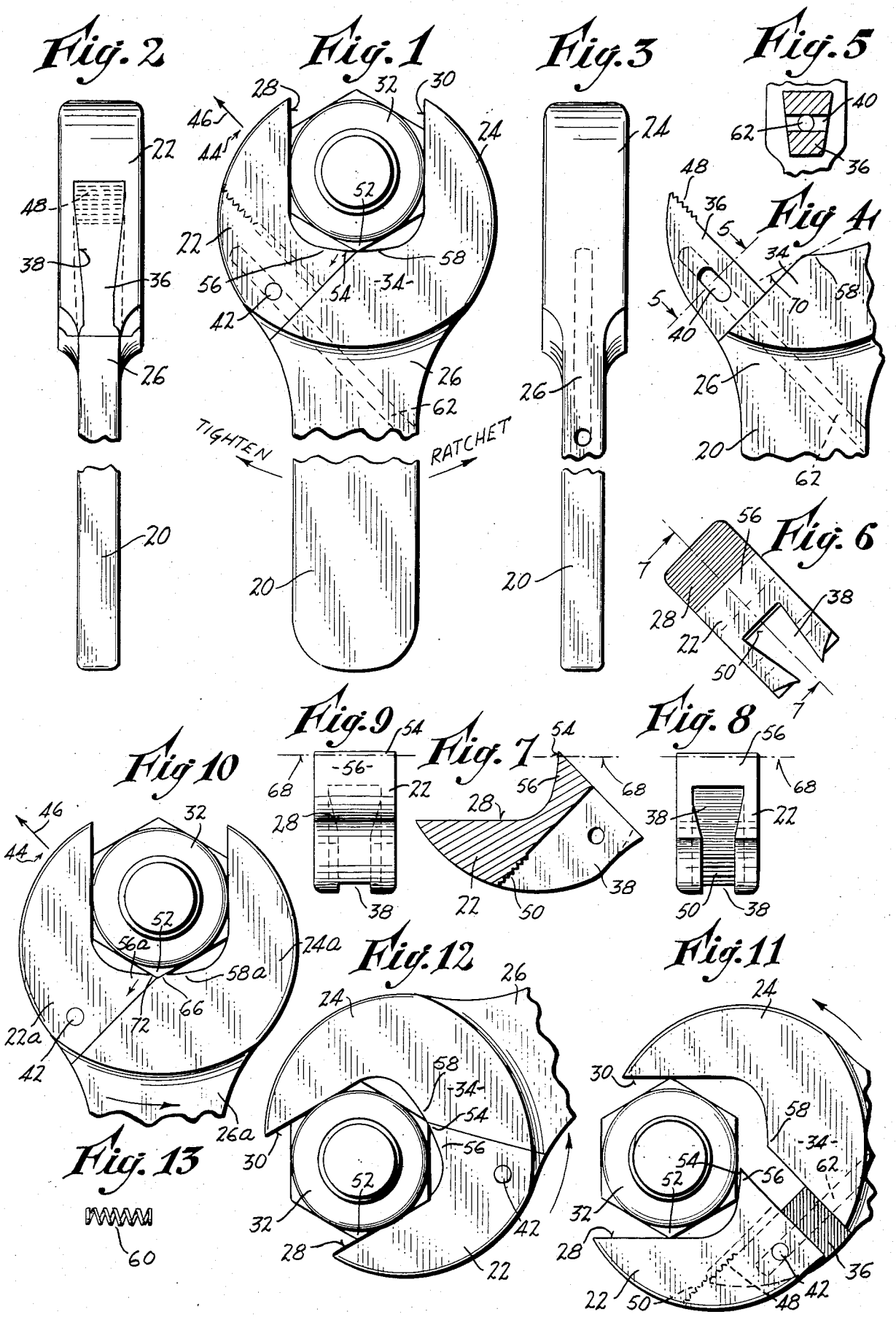
FIG. 1 is a side plan view of the improved ratchet-action open-end wrench of the invention, with portions of the handle being broken away for convenience of illustration. The wrench is shown as applied to an hexagonal nut.
FIG. 2 is a left edge elevational view of the wrench of FIG. 1.
FIG. 3 is a right edge elevational view of the wrench of FIG. 1.
FIG. 4 is a fragmentary detail of the handle component of the wrench of FIG. 1, with the movable jaw portion removed therefrom.
FIG. 5 is a section taken on the line 5—5 of FIG. 4.
FIG. 6 is an exterior elevational view of the movable jaw portion of the wrench.
FIG. 7 is a section taken on the line 7—7 of FIG. 6.
FIG. 8 is an elevational view of the movable jaw portion of the wrench as seen from the right of FIG. 7.
FIG. 9 is an elevational view of the movable jaw portion of the wrench as seen from the left of FIG. 7.
FIG. 10 is a fragmentary side plan view of a wrench illustrating a modification of the invention.
FIG. 11 is a fragmentary view of the wrench of FIG. 1, illustrating the process of bypassing a second pair of opposite corners of an hexagonal nut, considering the starting position of FIG. 1.
FIG. 12 is a view of the wrench of FIGS. 1 and 11, showing a succeeding position wherein the wrench has attained a new and third driving position, from the starting position of FIG. 1.
FIG. 13 is a side elevational view of a biasing spring for the movable jaw portion of the wrench.

As shown, the improved wrench of the invention comprises an elongate handle 20 having a pair of jaw portions 22, 24 at one end 26, said jaw portions having nut-engageable faces 28, 30 which are adapted to grasp opposite faces of an hexagonal nut 32. The jaw portions 22, 24 further comprise a two-part yoke 34 extending between the faces 28, 30 of the jaw portions 22, 24. The engagement of the nut faces with the jaw faces 28, 30 is a driving one when the handle 20 is moved forward, that is, turned or swung clockwise as indicated by the arrow labelled "TIGHTEN" in FIG. 1.

The jaw portion 22 is movable with respect to the handle 20 and jaw portion 24. In enabling such movement to occur, cooperable slide mounting means are provided on the movable jaw portion 22 and handle 20, said mounting means guiding the jaw portion 22 whereby it can shift with a translational movement along an oblique path on the handle end 26, and to have essentially translational movement between a closed, nut-gripping position as seen in FIGS. 1 and 12 wherein it is located towards but spaced from the other jaw portion 24 and an open, nut-releasing position (FIG. 11) located further away from said other jaw portion 24.

As provided by the invention, such slide mounting means comprises a dovetail 36 on the handle 20 and a dovetail groove 38 in the jaw portion 22, which is adapted to receive the dove-tail 36. A reasonably loose fit is provided between the dovetail 36 and the dovetail groove 38, with only a very slight amount of looseness permitted to enable a limited rocking movement of the jaw portion 22 to occur for the purpose of selectively controlling the gripping and releasing action of the movable jaw portion 22 as explained below.

The slide mounting means provided by the invention further comprises a pin and slot guiding connection between the handle 20 and the movable jaw portion 22. In effecting this the dovetail 36 of the handle 20 has a slot 40 extending obliquely and passing through it from one side to the other, as seen in FIG. 4. Received in the slot 40 is a cross pin 42 carried by the movable jaw portion 22, such pin acting as a guide in conjunction with the slot 40 and also functioning as a pivot for controlling a limited rocking movement of the movable jaw portion 22 about the pin 42 as an axis.

In FIG. 1 such limited rocking movement is indicated by the short arrow 44, and the much greater oblique translational movement which is permitted by the length of the slot 40 is indicated by the long arrow 46. In connection with such rocking movement of the jaw portion 22, the dovetail 36 is provided with a series of interposed ridges and hollows designated 48, and the transverse wall of the dovetail groove 38 in the movable jaw portion 22 is provided with a cooperable series of interposed ridges and hollows 50. As seen in FIG. 1, the ridges and hollows of the dovetail 36 of the handle 20 and of the movable jaw portion 22 are in interfitting engagement. However, disengagement of the cooperable ridges and hollows 48, 50 can occur if the movable jaw portion 22 is rocked slightly clockwise as viewed in FIG. 1.

For convenience of illustration, the showing of the ridges and hollows 48, 50 is purposely exaggerated in the drawings. Actually the ridges and hollows 48, 50 are similar to shallow knurling, and the ridges thereof have camming or sloping surfaces whereby a positive locking or interlocking between the configurations 48, 50 without accompanying pressure does not occur. The slight rocking movement of the movable jaw portion 22 which can effect disengagement of the ridges and hollows 48, 50 is produced by the lower corner 52 of the nut 32, such corner applying a pressure to a pusher surface 54 of the yoke part 56 of the movable jaw 22 as indicated by the short arrow in FIG. 1, and occurring when the handle 20 is swung counterclockwise as viewed in the figure, in the direction of the arrow labelled "RATCHET". The active portion of the pusher surface 54 is in the form of a narrow elongate land on the said yoke part 56, where it adjoins the other yoke part 58 of the jaw portion 24.

As seen in FIGS. 1, 11 and 12, the jaw portions 22, 24 have the conventionally configured yoke parts 56, 58 which together make up the yoke configuration 34 at the open end 26 of the wrench.

In accordance with the invention, completely enclosed and protected means are provided, biasing the movable jaw portion 22 towards its closed, nut-gripping position shown in FIGS. 1 and 12. This biasing means comprises a coil compression spring 60, FIG. 13, which is disposed in a transverse bore 62 of the handle 20 and which extends into the dovetail 36 thereof, intersecting the slot 40. The spring 60 is located in the uppermost end of the bore 62, and engages the cross pin 42 of the movable jaw portion 22, tending to maintain the latter always in its closed, nut gripping position of FIGS. 1 and 12.

The operation of the improved ratchet-type wrench of the invention can now be readily understood. Considering FIG. 1, when the handle 20 is swung clockwise, as indicated by the arrow labelled "TIGHTEN", two opposite corners of the nut 32 will apply force to the two jaw portions 22, 24 in such a manner that the movable jaw portion 22 tends to pivot counterclockwise, forcing the knurling 48, 50 of the dovetail 36 and dovetail groove 38 into a more forceful engagement and preventing any translational movement of the movable jaw portion 22. Therefore, no separation of the jaw portions 22, 24 will occur, and the nut 32 will be tightly gripped for driving it clockwise However, when the handle 20 is subjected to a reverse or counterclockwise turning force, the lowermost corner 52 of the nut 32 will now bear against the pusher surface 54 of the movable jaw portion 22 to cause a very slight canting or rocking of the latter, which is sufficient to disengage the knurled interfitting configurations 48, 50 whereby the jaw portion 22 can translationally shift obliquely and away from the jaw portion 24, as seen in FIG. 11. This will allow a bypass of the corners of the nut 32 by the jaw portions 22, 24, and enable the wrench to secure another driving grip on the nut 32, now as shown in FIG. 12. The arrows in FIGS. 11 and 12 indicate the direction of ratchet turning of the wrench. FIG. 12 is the position which directly follows the position of FIG. 11, whereas the position of FIG. 11 was the result of a second bypass, from the position of FIG. 1, as will be understood.

The functioning of the ratchet action requires that the yoke portion 34 of the wrench be maintained in contact with the the hexagonal nut or bolt head, as will be understood.

Another embodiment of the invention is illustrated in FIG. 10, wherein the yoke parts 56*a* and 58*a* of the jaw portions 22*a* and 24*a* are configured to form a notch or V-groove 66 extending transversely of the wrench end 26*a*. Such V-groove can be formed by making cuts indicated by the broken lines 68 and 70 in the movable jaw portion 22 and handle 20, as seen in FIGS. 4 and 7–9. One side wall of the V-groove, indicated at 72 in FIG. 10 constitutes a pusher surface in the form of a narrow elongate land which is adapted for engagement by the corner 52 of the hexagonal nut 32 as seen in FIG. 10, thereby to effect a positive shifting of the jaw portion 22*a* away from its nut-gripping and nut-driving position of FIG. 10 toward the open, nut-releasing position such as is shown in FIG. 11.

Variations and modifications of the invention are possible without departing from the scope of the invention as defined in the appended claims.

Each and every one of the appended claims defines an aspect of the invention which is separate and distinct from all others, and accordingly each claim is intended to be treated in this manner when examined in the light of the prior art devices in any determination of novelty or validity.

I claim:

1. A ratchet-action open-end wrench comprising, in combination:

(a) an elongate handle having a pair of jaws at one end which have nut-engageable faces and are adapted to grasp opposite faces of an hexagonal nut when the handle is moved forward, (b) one of said jaws being movable with respect to said handle, (c) cooperable slide mounting means including interfitting dovetail sliding portions of said movable jaw and handle, said dovetail sliding portions having a predetermined direction of relative movement for guiding said movable jaw to enable the entire said jaw to shift with translational movement along an oblique path on said handle end and to have essentially translational movement between a closed nut-gripping and nut-driving position located towards but spaced from said other jaw and an open, nut-releasing position located further away from said other jaw, said slide-mounting means having a reasonably loose fit to enable a limited rocking movement of the movable jaw to (d) means biasing said movable jaw towards its closed nut-gripping position, (e) cooperable, separable interfitting means on said movable jaw and handle, tending to resist shifting of the movable jaw from its closed, nut-gripping position, and (f) a pivot pin rigidly carried by said movable jaw, said handle having a slot in one of said dovetail portions, extending generally parallel to the direction of relative movement of said portions, and said pivot pin being received and movable in said slot to enable the movable jaw to pivot as a result of application of pressure from the nut thereon, causing separation of said interfitting means and translational shifting of the movable jaw by said nut toward said nut-releasing position.

2. The invention as set forth in claim 1, wherein:

(a) said handle has an elongate bore extending into the dove-tail sliding portion thereof, (b) said biasing means comprises a compression spring disposed in said elongate bore and having an end seated against the bottom wall thereof, said slot intersecting the elongate bore of the handle, and the pivot pin engaging an opposite end of the said biasing means, thereby urging the movable jaw towards its closed nut-gripping position.

3. The invention as set forth in claim 1, wherein:

(a) said jaws comprise a two-part yoke extending between the faces of the jaws of the wrench, (b) said jaws together forming a V-groove in said yoke, said V-groove being substantially aligned with the axis of the wrench handle, and having oppositely disposed side walls, one on each jaw, said V-groove being adapted to receive one of the two corners of the hexagonal nut which are remote from the jaw faces, (b) the engagement of the one corner of the nut with that wall of the V-groove on the movable jaw applying pressure to the latter in a direction tending to shift the movable jaw toward its open, nut-releasing position when the wrench is turned.

* * * * *